United States Patent [19]

Pekala

[11] 4,025,105

[45] May 24, 1977

[54] SPORTS (BACK) SEAT

[76] Inventor: Charles T. Pekala, 411 Lowry Road, Erie, Pa. 16511

[22] Filed: Sept. 10, 1973

[21] Appl. No.: 395,390

[52] U.S. Cl. ..... 297/4
[51] Int. Cl.[2] ..... A47C 1/00
[58] Field of Search ..... 297/4, 219; 2/2; 9/347

[56] References Cited

UNITED STATES PATENTS

| | | | |
|---|---|---|---|
| 2,620,494 | 12/1952 | Kay | 297/219 UX |
| 2,621,327 | 12/1952 | Amoroso | 297/4 UX |
| 2,736,030 | 2/1956 | Moody | 297/4 X |
| 3,054,637 | 9/1962 | Pambello | 297/4 |
| 3,093,407 | 6/1963 | Wilson | 297/4 |

FOREIGN PATENTS OR APPLICATIONS

| | | | |
|---|---|---|---|
| 170,162 | 7/1951 | Austria | 297/4 |

*Primary Examiner*—Roy D. Frazier
*Assistant Examiner*—William E. Lyddane

[57] ABSTRACT

A sportman's seat or the like made up of a generally rectangular cushion with a cover made of sheet material. A resilient strap which forms a belt for the sportsman is attached to D-shaped rings at each end. Each ring has a tab passing through it. The ends of the tab receive the ends of the cushion cover and are attached to it. The ends of the cushion cover are fixed together entirely across the width of the end except that a space between the cover ends is provided directly under the tab so that air can be expelled from within the cover when the sportsman sits on the seat.

1 Claim, 8 Drawing Figures

Fig. 1
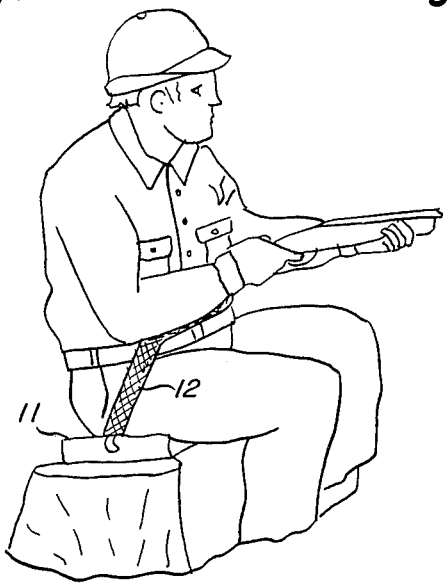
Fig. 2
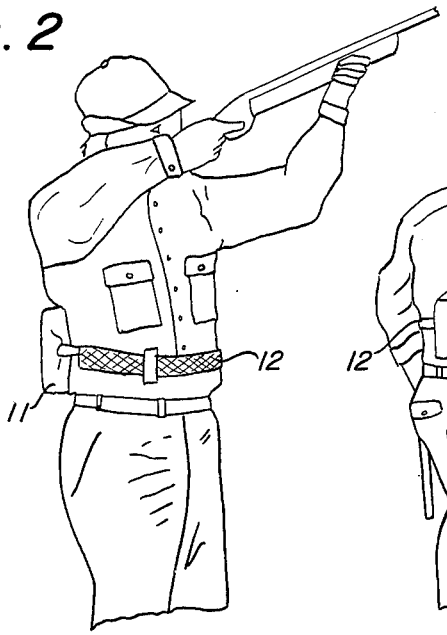
Fig. 3
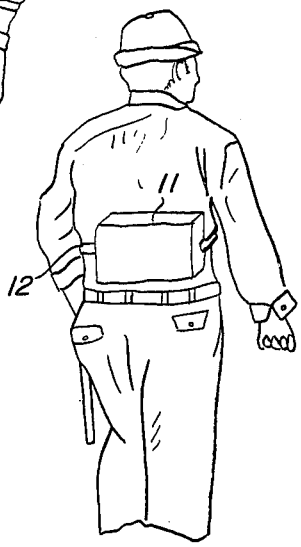
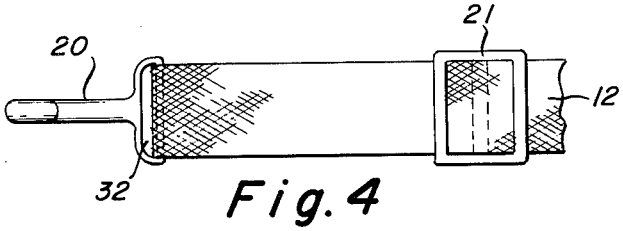
Fig. 4
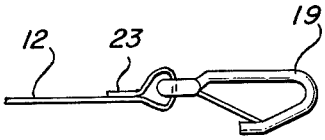
Fig. 5
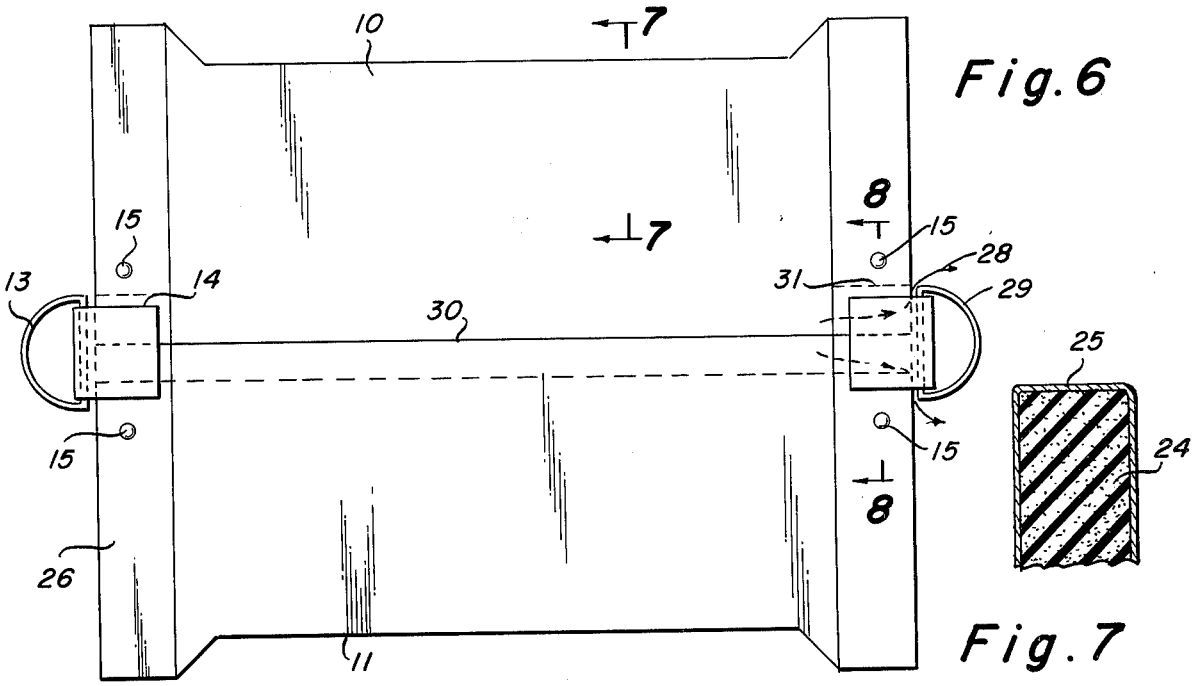
Fig. 6
Fig. 7
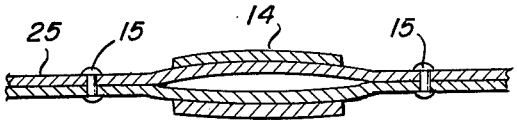
Fig. 8

SPORTS (BACK) SEAT

REFERENCE TO PRIOR ART

The seat disclosed herein constitutes an improvement over the seats shown in U.S. Pat. Nos. 3,093,407, 2,664,939, and 2,736,030.

OBJECTS OF THE INVENTION

An object of the invention is to provide an improved seat for sportsmen.

Another object of the invention is to provide a portable seat for sportsmen.

Another object of the invention is to provide a portable seat that is supported to the body by an elastic belt and can be readily moved to position for use with a minimal amount of effort.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

FIG. 1 is a view of the seat in use by a hunter.

FIG. 2 shows a side view of the seat with the hunter in standing position.

FIG. 3 shows a rear view of the seat with the hunter in standing position.

FIG. 4 shows an enlarged partial view of one end of the strap, with adjusting buckle.

FIG. 5 shows a partial enlarged view of the opposite end of the strap, non-adjusting.

FIG. 6 shows an enlarged view of the seat, less strap.

FIG. 7 shows a cross sectional view taken on line 7—7 of FIG. 6.

FIG. 8 is a partial cross sectional view taken on line 8—8 of FIG. 7.

DETAILED DESCRIPTION OF THE DRAWINGS

The sportsman's seat disclosed herein is indicated generally at 10. It has a cushion 11 and both ends of the elastic strap 12 are fixed to the ends of the cushion. The cushion 11 is made up of a generally rectangular shaped block of foam material 24 received in the sheetlike cover 25. The sheetlike cover 25 is sealed along the seam 30 and its ends are abutted together at 26 and sealed together and further reinforced by rivets 15. The D-shaped rings 13 and the tabs 14 may be made of the same plastic sheet material as the cover 25 and the tabs 14 are sealed to the outside of the cover. The ends of the cover are sealed together adjacent each side with a suitable cement heat seal or the like and the seal terminates along the lines 31 so that air can be expelled from the cushion when the hunter or sportsman sits on the seat and compresses it. Thus air can escape in the direction indicated by the arrows 28 between the ends of the tabs at 29. The ends of the cover 25 are flared out at 26 generally as shown. A snap 19 is held on one end of the resilient web strap 12 by the end 23 being bent back on itself and passed through the hole 32 in the snap and fixed to the strap. The opposite end of the resilient strap 12 passes through the opening or hole 32 and the snap 20 and is received in the buckle 21. The snaps 19 and 20 can be snapped into the rings 13 and the strap adjusted to a comfortable position on the midsection of the hunter. The seat is symmetrical about its vertical center line.

In use, the hunter may put the strap around his midsection and fix the seat into the small of his back, as shown in FIG. 2, where he will be free to walk or move his arms, as shown, in FIGS. 2 and 3. If he desires to rest, he may bring the cushion 11 under his hips by stretching the straps and sit on the cushion as shown in FIG. 1. Then if he decides to rise quickly, he may get to his feet and allow the cushion 11 to slide to the position shown in FIG. 2.

The seat is nestled at the small arched part of the back. It is almost undetectable when worn underneath a coat or jacket. Attached to the body at all times, it cannot be lost or mislaid while in use. Instant action by the sportsman is not hindered, as is the case with a loose unattached seat.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A seat comprising a generally rectangular cushion and a resilient strap, said seat being made of relatively thin rectangular shaped block of foam material, a cover over said block of material made of sheet-like material, the ends of said sheet-like material extending beyond the ends of said block of foam material and engaging each other in face to face relationship and sealed together providing an opening, a tab means at each end of said sheet-like material, said tab means being folded back on itself in U-shape and receiving the ends of said sheet-like material therebetween, a D-shaped ring received in each said tab means, said strap having a snap attached to each end thereof and each snap engaging a respective D-shaped ring, one end of said strap having a buckle whereby the lengths of said strap can be adjusted, said strap being adapted to be disposed around the midsection of a person whereby the cushion is held to the small of said person's back adapted to be stretched whereby said cushion can be brought down below said person's hips to serve as a seat and to remain below said person when said person is in the sitting position.

* * * * *